US005498089A

United States Patent [19]

Motyka

[11] Patent Number: 5,498,089

[45] Date of Patent: Mar. 12, 1996

[54] HOLDER FOR PEN-LIKE ARTICLES

[75] Inventor: Kenneth J. Motyka, Mt. Prospect, Ill.

[73] Assignee: Deluxe Craft Manufacturing Co., Chicago, Ill.

[21] Appl. No.: 360,800

[22] Filed: Dec. 7, 1994

[51] Int. Cl.[6] ..... B42F 3/00

[52] U.S. Cl. ..... 402/4; 281/30; 402/79

[58] Field of Search ..... 281/28, 30, 38, 281/51; 402/4, 79, 80 R

[56] References Cited

U.S. PATENT DOCUMENTS

| | | | |
|---|---|---|---|
| 637,889 | 11/1899 | Parker et al. . | |
| 1,097,619 | 5/1914 | Fuller . | |
| 1,346,393 | 1/1920 | Woodhouse . | |
| 1,467,534 | 9/1923 | Crook, Jr. . | |
| 1,904,572 | 4/1933 | Trussell . | |
| 2,068,740 | 1/1937 | Rezner | 129/1 |
| 2,160,392 | 5/1939 | Schade | 129/1 |
| 2,184,823 | 12/1939 | Vernon | 129/1 |
| 2,200,146 | 9/1939 | Block | 281/30 |
| 2,647,517 | 6/1949 | Bilbrey | 129/1 |
| 2,704,077 | 9/1953 | Prillaman | 129/1 |
| 2,821,197 | 6/1953 | Bilbrey | 129/1 |
| 3,126,891 | 5/1962 | Caputi | 129/1 |
| 4,075,702 | 2/1978 | Davies | 281/30 X |
| 4,244,660 | 1/1981 | Aronson | 402/79 |
| 4,820,071 | 4/1989 | Steinfield et al. | 402/4 |
| 4,875,707 | 10/1989 | Krom | 281/30 |
| 4,909,652 | 3/1990 | Harrison | 402/80 R |
| 5,006,699 | 4/1991 | Felkner et al. | 281/30 X |

FOREIGN PATENT DOCUMENTS

| | | | |
|---|---|---|---|
| 458618 | 10/1913 | France . | |
| 3820274 | 12/1989 | Germany | 281/30 |
| 1564220 | 4/1980 | United Kingdom . | |

*Primary Examiner*—Willmon Fridie, Jr.

*Attorney, Agent, or Firm*—Marshall, O'Toole, Gerstein, Murray & Borun

[57] ABSTRACT

A holder for pen-like articles for use in conjunction with a loose-leaf ring binder is made from a sheet of resilient material having first and second edges. The sheet has series of holes near and parallel to the first edge. At least one of the holes is an elongate hole so that the holder can be installed in any one of a variety of loose-leaf ring binders having different spacings between rings. The sheet is curved back upon itself at the second edge to form a cylindrical passage suitable for holding a pen or similarly sized article. The resiliency of the sheet and the size of the passage allow the holder to accommodate a pen-like articles having a range of diameters and/or cross-sections that vary along the lengths of the articles.

12 Claims, 1 Drawing Sheet

HOLDER FOR PEN-LIKE ARTICLES

FIELD OF THE INVENTION

The present invention relates to pen or pencil holders particularly suited for use with loose-leaf ring binders.

BACKGROUND OF THE INVENTION

Pen or pencil holders for use in conjunction with loose-leaf ring binders, such as 3-ring binders, are known in the art. These holders allow the user to keep a pen or pencil in a convenient location and readily available for use. Preferably, the holder is held in place by the rings of the binder in which it is installed and may be removed from the binder when convenient;.

Schade U.S. Pat. No. 2,160,392 and Vernon U.S. Pat. No. 2,184,823 disclose pencil holders which are held in place using a single ring of a ring binder. These pencil holders are constructed of sheet metal.

Prillaman U.S. Pat. No. 2,704,077 discloses a pen and pencil holder which is also held in place in a ring binder by a single ring. The Prillaman pen and pencil holder has an elastic retainer that surrounds the holder and secures the pen or pencil.

Caputi U.S. Pat. No. 3,126,891 discloses an article holder for use with a loose-leaf notebook which has a series of depressions formed in a panel. The articles, such as pens or pencils, are pressed into the depressions and snap into place due to the fact that the depressions are more than semicircular in cross-section.

Aronson U.S. Pat. No. 4,244,660 discloses a container for marking instruments which may be attached to a notebook page for placement in a ring type binder. The container has two strips of material, each having a series of truncated, semiconical, open-ended pockets. The pockets are arranged such that one end of a marking instrument is held in a pocket of the first strip and a second end of the marking instrument is held between two pockets of the second strip.

Woodhouse U.S. Pat. No. 1,346,393 discloses a pen or pencil clip which has a cylindrically shaped portion for holding a pen or pencil at one side of the clip, and a clamping portion at a second side of the clip. The clamping portion is adapted to attach to a memoranda pad or the like.

Crook, Jr., U.S. Pat. No. 1,467,534 discloses a ruler adapted to be held in a loose leaf binder having two leaf retaining members. The ruler has a series of holes and a slot which allows the ruler to be used in binders having differing spacing between the leaf retaining members.

Today there is a wide variety of types and sizes of loose-leaf ring binders. These binders are often used as notebooks, address books and/or calendars. In particular, there are variations in the spacing between the rings of these binders. In addition, pens and pencils come in a variety of sizes and shapes. Thus, despite the foregoing devices, there is a need for a pen and pencil holder which is capable of being used in a variety of types of loose-leaf ring binders. There is also a need for a pen and pencil holder which can accommodate a variety of sizes of pens and pencils and which can securely hold pens and pencils having varying cross-sectional geometries.

SUMMARY OF THE INVENTION

In accordance with of the present invention, a holder for a pen-like article is formed from a sheet of resilient material, such as plastic or metal, having a first elongate edge and a second elongate edge. The first edge has a plurality of holes adjacent thereto for engaging rings in a ring binder; and the sheet has a curved portion forming a cylindrical passage to releasably securely retain a pen-like article.

At least one of the holes may be elongated in a direction substantially parallel to the longitudinal axis of the first side.

While the present application refers hereinafter to a holder for pens, it should be understood that the present invention may be used to hold not only pens but also other writing implements, such as pencils and other similarly sized, cylindrically shaped objects, all collectively referred to hereinafter as pen-like articles. Other features and advantages of the present invention will become apparent to those skilled in the art from the following detailed description, considered in conjunction with the accompanying diagrammatic drawings.

DETAILED DESCRIPTION

Figure 1:
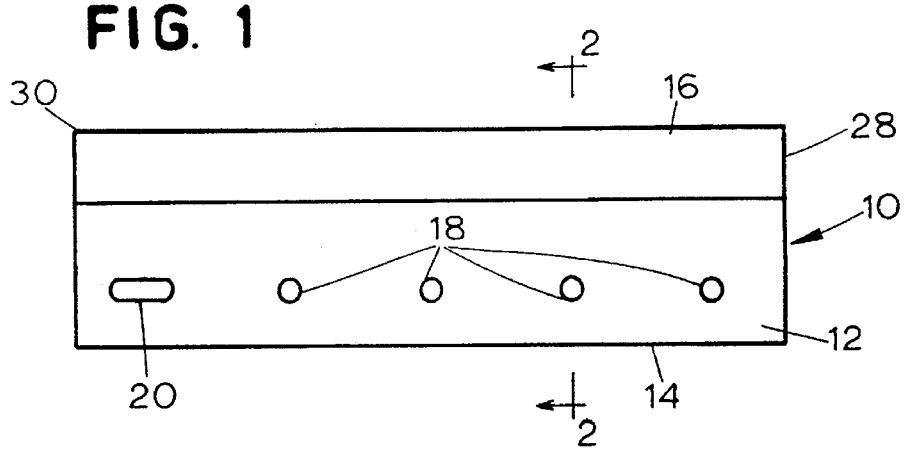
FIG. 1 is a plan view of an embodiment of a pen holder of present invention.

Referring to FIG. 1, a pen or pencil holder 10 includes a sheet 12 which may be formed from a polymer material, such as polyvinyl chloride (PVC), sheet metal, or any other resilient material. Preferably, if made from PVC, the sheet 12 has a thickness of about 0.015–0.020 inches. The sheet 12 has a first elongate edge 14 and a second elongate edge 16. The length of the sheet 12 along the first and second edges 14, 16 is about 3.75 inches. The width of the sheet in a direction perpendicular to the first and second edges 14, 16 is about 1.125 inches.

A series of circular holes 18 and preferably at least one elongate hole 20 are disposed near and parallel to the first edge 14. Each hole 18 has a diameter of about 0.125 inches. The holes 18 are evenly spaced along the first edge 14 with about 0.75 inches between the center of each hole 18. The hole 20 has a length of about 0.375 inches in the direction parallel to the first edge 14, and a width of about 0.125 inches in the direction perpendicular to the first edge 14.

Figure 2:
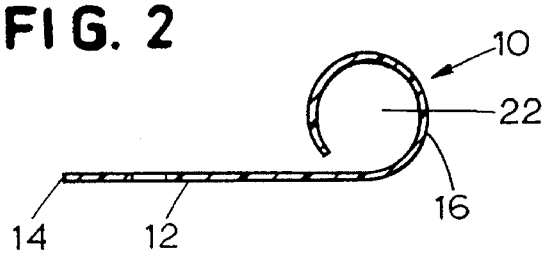
FIG. 2 is a cross-sectional view of the pen holder of FIG. 1, taken along line 2—2.
Figure 3:
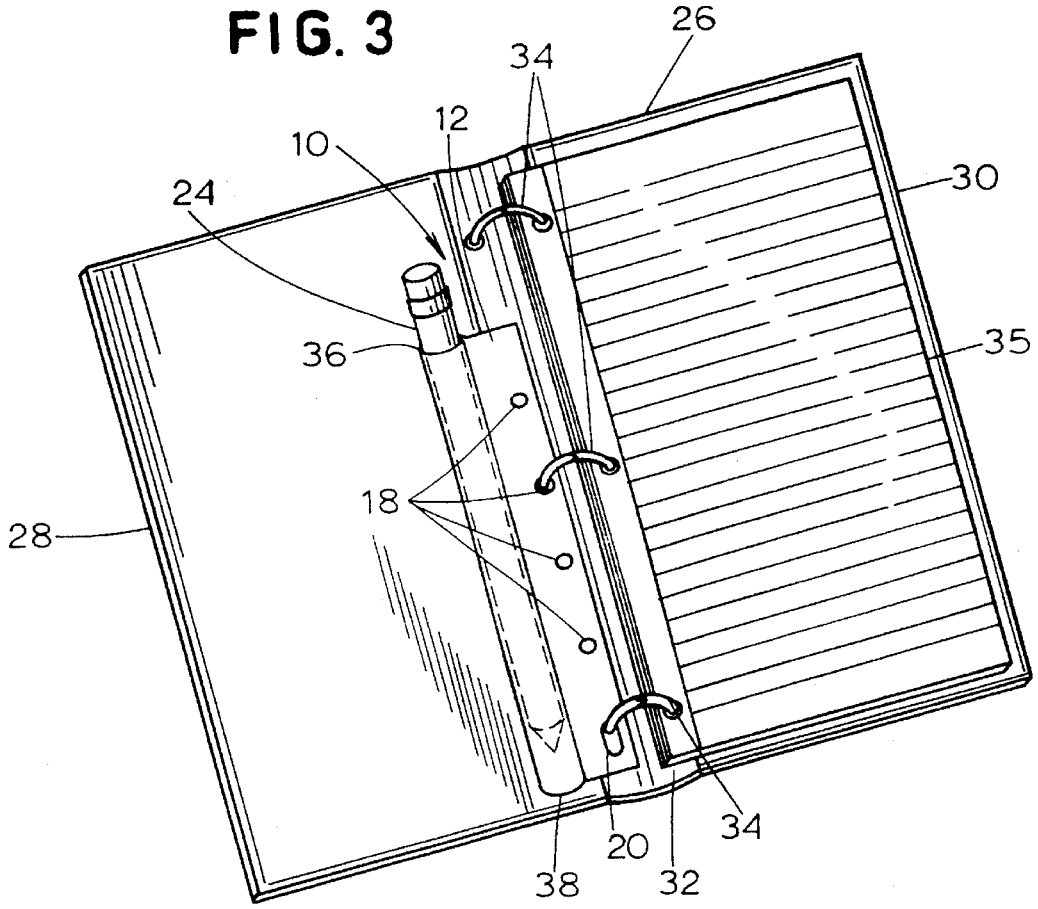
FIG. 3 is a plan view of a pen holder in accordance with the present invention, shown installed in a 3-ring looseleaf binder.

The hole 20 allows the holder 10 to be installed in loose-leaf ring binders having different spacings between rings. For example, the holder 10 shown in FIGS. 1–3 is capable of accepting the rings of a six inch six ring binder or the rings of an 8½ inch three ring binder. Thus, a single holder 10 may be designed which may be used in any of a number of different types of loose-leaf ring binders.

The second edge 16 (FIG. 2) is along a portion of the sheet 12 which is curved back upon itself to form a substantially closed cylindrical passage 22. The passage 22 is sized such that it can releasably securely retain a pen 24 (FIG. 3) or pencil or another similarly sized pen-like article such as, for example, a laser pointer. The size of the passage 22 and the resiliency of the plastic, sheet metal or other material from which the holder 10 is formed allow the passage 22 frictionally to engage, and thereby releasably securely retain, a pen 24 or other pen-like article having a range of diameters and/or having a diameter which varies or is tapered along its length. For example, the cylindrical passage 22 may have an inside diameter of about 0.375 inches. Although the cylindrical passage 22 is substantially closed when it is not holding anything, the insertion a large diameter pen 24 into the cylindrical passage 22 will cause the cylindrical passage 22 to open.

FIG. 3 shows the holder 10 installed in a 3-ring loose-leaf binder 26. The binder 26 has a front cover 28, a back cover 30, a spine 32 located between the covers 28 and 30, and a plurality of rings 34 that retain sheets of paper 35 and the holder 10 in the binder 26. Typically, the binder 26 includes a mechanism in which the upper sides of the rings 34 are split so that the rings 34 may be opened outwardly from the center of the spine 32, as is well known in the art. Opening the rings 34 allows for the insertion or removal of sheets of paper 35 and/or the holder 10. In use, the holder 10 is held in place in the binder 26 by two or more of the rings 34 that pass through the holes 18 and 20.

The holder 10 shown in FIG. 3 is held in the binder 26 by a ring 34 passing through one of the holes 18 and by a ring 34 passing through the hole 20. However, the holder 10 may be held even more securely in a binder in which two or more rings pass through holes 18 in addition to a ring which passes through the hole 20. The pen 24 may be inserted into the holder 10 from either of two ends 36, 38 of the passage 22.

Although the holder 10 shown in FIGS. 1–3 has a substantially rectangular shape, variations may be made in its shape. For example, the first edge 14 may be curved instead of straight. Additionally, the passage 22 need not be continuous and may contain notches or holes along its length for decoration or for minimizing material.

Other modifications and variations of the present invention will be apparent to those skilled in the art after considering the above disclosure. Thus, it should be understood that the invention set forth in the appended claims may be practiced otherwise than as specifically set forth hereinabove.

What is claimed and desired to be secured by Letters Patent is:

1. A holder for a pen-like article comprising:

a sheet of resilient material, said sheet having a first elongate edge and a second elongate edge;

a plurality of spaced apart holes formed in said sheet along the length of and adjacent to the first edge; and a curved portion formed in said sheet intermediate said first and second edge and along the length of and adjacent to said second edge to define a substantially cylindrical passage, said passage being adapted to releasably securely retain a pen-like article.

2. A holder as recited in claim 1 wherein the sheet is formed from a polymer.

3. A holder as recited in claim 2 wherein the sheet is formed from polyvinyl chloride.

4. A holder as recited claim 1 wherein the sheet is formed from metal.

5. A holder as recited claim 1 wherein the holes are arranged substantially parallel to the first edge.

6. A holder as recited in claim 1 wherein the holes are adapted to engage rings in a ring binder.

7. A holder as recited in claim 6 wherein the dimension of at least one of the holes in a direction substantially parallel to the first edge is greater than the dimension of said hole in a direction substantially perpendicular to the first edge.

8. A holder for a pen-like article comprising:

a sheet of resilient material having a first elongate edge and a second elongate edge, said sheet being formed from a polymer;

a plurality of holes formed in said sheet along the length of and adjacent to the first edge, said holes being adapted to engage rings in a ring binder; and a curved portion formed in said sheet intermediate said first and second edges and along the length of and adjacent to said second edge defining a substantially cylindrical passage, said passage being adapted to releasably securely retain a pen-like article.

9. A holder as recited in claim 8 wherein the dimension of at least one of the holes in a direction substantially parallel to the first edge is greater than the dimension of said hole in a direction substantially perpendicular to the first edge.

10. A holder for a pen-like article comprising:

a sheet of resilient material having a first edge and a second edge;

a plurality of holes formed in said sheet along and adjacent to the first edge, said holes being adapted to engage rings in a ring binder; and a curved portion formed in said sheet intermediate said first and second edges and along the length of said second edge to define a substantially closed cylindrical passage for releasably securely retaining a pen-like article.

11. A holder as recited in claim 10 wherein the sheet is formed at least in part from polyvinyl chloride.

12. A holder as recited claim 10 wherein the sheet is formed from metal.

* * * * *

UNITED STATES PATENT AND TRADEMARK OFFICE

CERTIFICATE OF CORRECTION

PATENT NO. : 5,498,089

DATED : March 12, 1996

INVENTOR(S) : Kenneth J. Motyka

It is certified that error appears in the above-identified patent and that said Letters Patent is hereby corrected as shown below:

On the title page, item [21], should read--08/350,800

In the Abstract, line 3, after "has" insert --a--.

In the Abstract, line 11, delete the 4th word "a".

Col. 1, line 15, after the word "convenient" delete the ";".

Col. 1, line 65, delete the 4th word "of".

Col. 2, line 21, after the 1st word "of" insert --the--.

Col. 3, line 47, the 4th word "edge" should be --edges--.

Signed and Sealed this

Sixteenth Day of July, 1996

*Attest:*

Bruce Lehman

BRUCE LEHMAN

*Attesting Officer*

*Commissioner of Patents and Trademarks*